United States Patent [19]

Luther

[11] Patent Number: 4,487,131

[45] Date of Patent: Dec. 11, 1984

[54] CARTRIDGE AMMUNITION

[75] Inventor: Hans W. Luther, Kaarst, Fed. Rep. of Germany

[73] Assignee: Rheinmetall GmbH, Duesseldorf, Fed. Rep. of Germany

[21] Appl. No.: 303,075

[22] Filed: Sep. 17, 1981

[30] Foreign Application Priority Data

Jul. 17, 1981 [DE] Fed. Rep. of Germany ..... 3037662

[51] Int. Cl.[3] ..... F42B 13/16

[52] U.S. Cl. ..... 102/523; 102/520

[58] Field of Search ..... 102/431, 520–523, 102/514–519, 524, 526, 527, 528, 529, 464, 465, 466, 439, 700, 430, 432, 433

[56] References Cited

U.S. PATENT DOCUMENTS

| | | | |
|---|---|---|---|
| 3,745,926 | 7/1973 | Mertz et al. | 102/523 X |
| 3,759,184 | 9/1973 | Blajda et al. | 102/520 X |
| 4,043,269 | 8/1977 | Ambrosini | 102/522 X |
| 4,284,008 | 8/1981 | Kirkendall et al. | 102/521 |

FOREIGN PATENT DOCUMENTS

| | | | |
|---|---|---|---|
| 2831574 | 2/1979 | Fed. Rep. of Germany | 102/529 |
| 1405996 | 6/1965 | France | 102/439 |

*Primary Examiner*—Harold J. Tudor
*Assistant Examiner*—Tyrone Davis

[57] ABSTRACT

Cartridge ammunition is provided comprising a subcaliber shall, a sabot attached to the shell, and a propellant case including a cartridge cover connected with a catch to the sabot. The cartridge cover is bulge-like bent and comprises spring parts protruding toward the axis and is formed conjugated to the positive adapted surfaces of the sabot concentrically surrounding the shell. Preferably slots are disposed at the spring parts protruding toward the axis of the bulge-like bent cartridge cover and the slots are preferably distributed uniformly over the circumference of the center end of the cartridge cover.

15 Claims, 4 Drawing Figures

CARTRIDGE AMMUNITION

BACKGROUND OF THE INVENTION

1. Field of the Invention

The present invention relates to cartridge ammunition comprising a shell, a propelling cage surrounding the shell, and a combustible propellant sabot including a cartridge cover.

2. Brief Description of the Background of the Invention Including Prior Art

In U.S. Pat. No. 3,981,246 cartridge ammunition is disclosed where the connection between a combustible propellant sabot and a sub-caliber shell is provided with a bolt connection. This bolt connection has proven to be very stable, however it is very expensive since additional connection parts and considerable assembly times are required.

SUMMARY OF THE INVENTION

1. Purposes of the Invention

It is an object of the present invention to provide cartridge ammunition where the connection between a subcaliber shell and the combustible propellant case are considerably simpler and easier to produce.

It is a further object of the present invention to provide a connection between a sabot and a propellant charge not requiring a bolt connection.

These and other objects and advantages of the present invention will become evident from the description which follows:

2. Brief Description of the Invention

The present invention provides cartridge ammunition comprising a sub-caliber shell, a sabot attached to the shell and a propellant case including a cartridge cover connected with a catch to the sabot. Preferably the catch provides for snap-in locking of the propellant case to the sabot. It is preferred if the catch provides clamping of the propellant case to the sabot.

In the context of the present invention a catch means a device which grips and/or fastens, however, a bolt type connection is expressly excluded. A snap-in locking means that the sabot and the propellant case are put in place by a snap-in motion resulting in locking the propellant case to the sabot. In the context of the present invention, clamping refers to a device for binding or pressing sabot and propellant case together and holding them firmly in their relative position, but it excludes expressly a bolt-type connection.

The cartridge cover can be bulged-like bent and can comprise spring parts protruding toward the axis. The bulge-like part can be formed conjugated to the positive adapted surfaces of the sabot concentrically surrounding the shell. There can also be provided slots disposed at the spring parts protruding toward the axis of the bulge-like bent cartridge with the slots substantially extending within planes wherein the shell axis is also embedded. The slots can be uniformly distributed over the circumference of the center end of the cartridge cover. A total of four slots can be provided disposed at angle intervals of 90° relative to each other.

The slots can extend at most to about the middle of the center end protruding radially more toward the axis of the shell.

The surface of the tail part of the sabot can be positive adapted to the front surface of the cartridge cover. The surface of the tail part of the sabot can comprise a surface of an annular groove recess against which a bulge of the cartridge is supported, a truncated cone-shaped surface against which center ends of the cartridge cover are pressing and the surface of a step disposed in a plane vertical to the longitudinal axis of the shell and against which the tip of the center end of the cartridge cover becomes locked.

A seal covering the tail part of the sabot can be provided. The catch providing parts of the sabot can be disposed on the seal surface. The end piece toward the shell axis of the seal can be shaped with an outer surface of about toroidal shape in part for providing safe and easy locking to the cartridge cover. The tail side of the sabot can comprise an annular groove recess which is bordered toward the axis and away from the axis in each case with truncated cone-shaped surfaces. The truncated cone-shaped surface disposed toward the axis of the shell can form an acute angle with the axis of the shell. Preferably the acute angle is less than about 20°. The truncated cone-shaped surface disposed away from the axis of the shell can form an angle of from about 40° to 50° with a plane vertical to the longitudinal axis of the shell. A guide collar can be provided surrounding the circumference of the sabot.

There is also provided a method for production of cartridge ammunition which comprises sliding a sabot over a sub-caliber shell and engaging a cartridge cover of a combustible propellant case with a catch connection to the sabot. Preferably, the sabot is solidly attached to the sub-caliber shell. The propellant case can be clamped and/or snap-in locked to the sabot. The outer edge of the sabot can be sealed with a seal disposed adjacent to the inner gun surface upon firing of the shell.

Slots can be disposed at spring parts protruding toward the axis of the shell and forming part of the bulge-like bent cartridge cover. The cartridge cover can engage the catch connection of the sabot by sliding with a substantially truncated cone edge over an in part about toroidal surface, which ends at a plane vertical to the shell axis thereby providing a snap-in locking between sabot and cartridge cover.

The invention accordingly consists in the features of construction, combination of elements, arrangement of parts and series of steps which will be exemplified in the device a method hereinafter described and of which scope of application will be indicated in the appended claims.

BRIEF DESCRIPTION OF THE DRAWING

In the accompanying drawing in which is shown one of the various possible embodiments of the present invention.

DESCRIPTION OF THE INVENTION AND PREFERRED EMBODIMENTS

In accordance with the present invention the cartridge ammunition comprises a sub-caliber shell with a sabot as well as propellant case including a cartridge cover which is characterized by a catch connection between the shell and the cartridge cover. The catch can be provided by spring parts protruding toward the inside of the cartridge cover, which is bent like a bulge, which spring parts are positively adapted to the surfaces of the tail part of the sabot concentrically surrounding the shell.

The cartridge ammunition according to the present invention in particular is distinguished by providing a safe connection between the sub-caliber shell and the propellant case made from combustible material, which connection is perfected by simply sticking together of sabot and propellant case. This simplifies considerably assembly operations and by saving the employment of bolts the production costs of the cartridge ammunition are substantially decreased. Finally, in contrast to conventional methods where the propellant case had to be provided in two parts for performing the bolting together, the propellant case can be formed from one piece in accordance with the present invention. This saves another assembly step, which had been required in the past for finishing of the propellant case.

Figure 1:
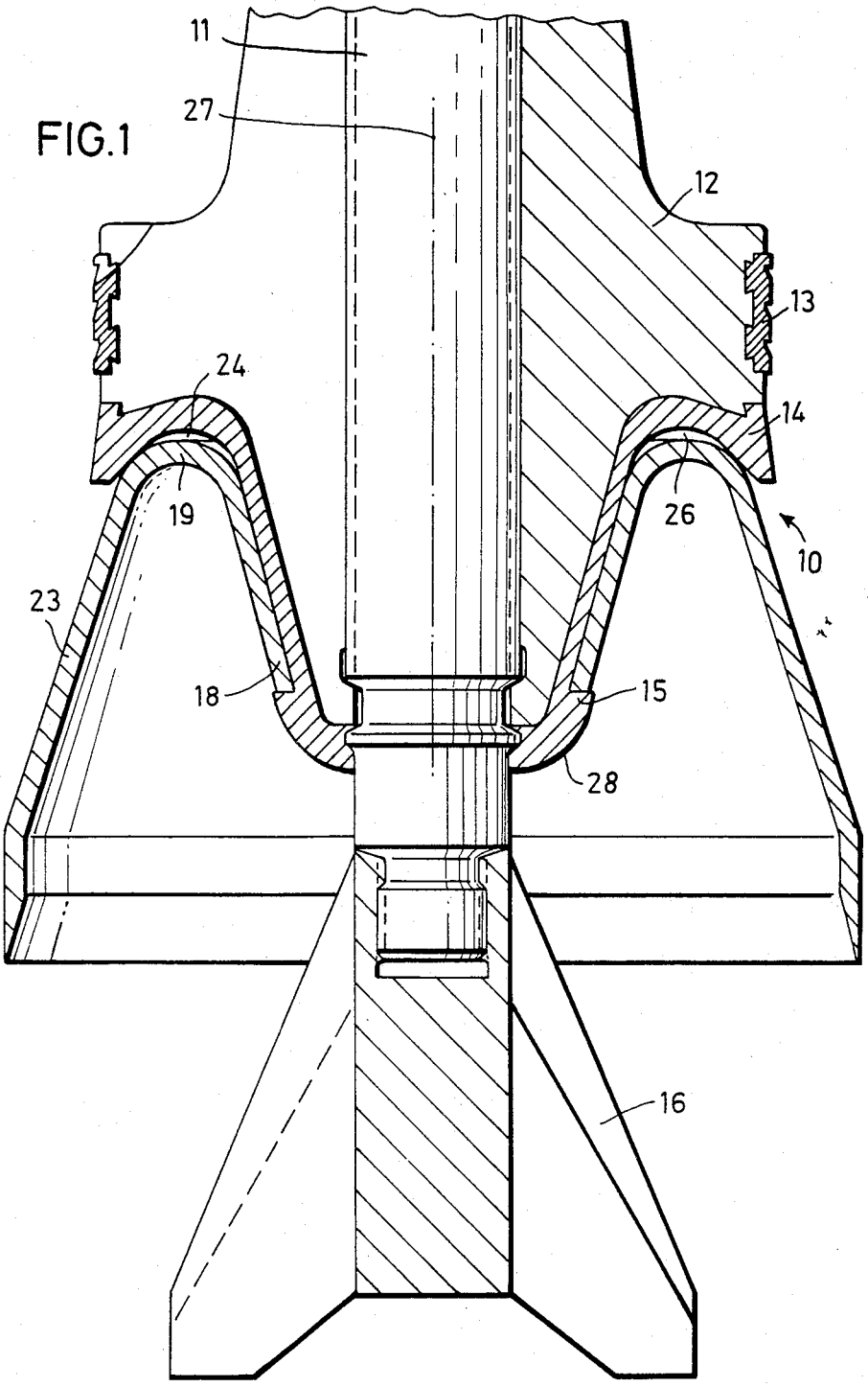
FIG. 1 is a view of a longitudinal section through part of a cartridge ammunition comprising a sub-caliber shell, a sabot and a cover of the propellant case.

Referring now to FIG. 1 there is shown a view of a longitudinal section through a part piece of the cartridge ammunition 10 comprising a sub-caliber shell, a sabot 12 surrounding the shell concentrically and a combustible propellant case, of which a part piece and in particular the cartridge cover 23 are shown in fact in FIG. 1. In accordance with the invention the propellant case in the area of the cartridge cover 23 is connected to the shell 11 via a catch connection. This catch connection provides a substantial simplification of assembly and mounting as well as a decrease in production costs as compared with the conventional connection of the combustible propellant case with the sabot via bolts. For providing a safe and all requirements meeting connection between the shell 11 and the combustible propellant case it is only necessary according to the invention to slide the propellant case from the tail side onto the shell until the catch engages. The catch is provided by spring parts 18 protruding toward the center of the bulge-bent cartridge cover 23, which spring parts positive adapt to shape-adhered surfaces 20, 21, 24 at the tail part of the sabot.

Figure 2:
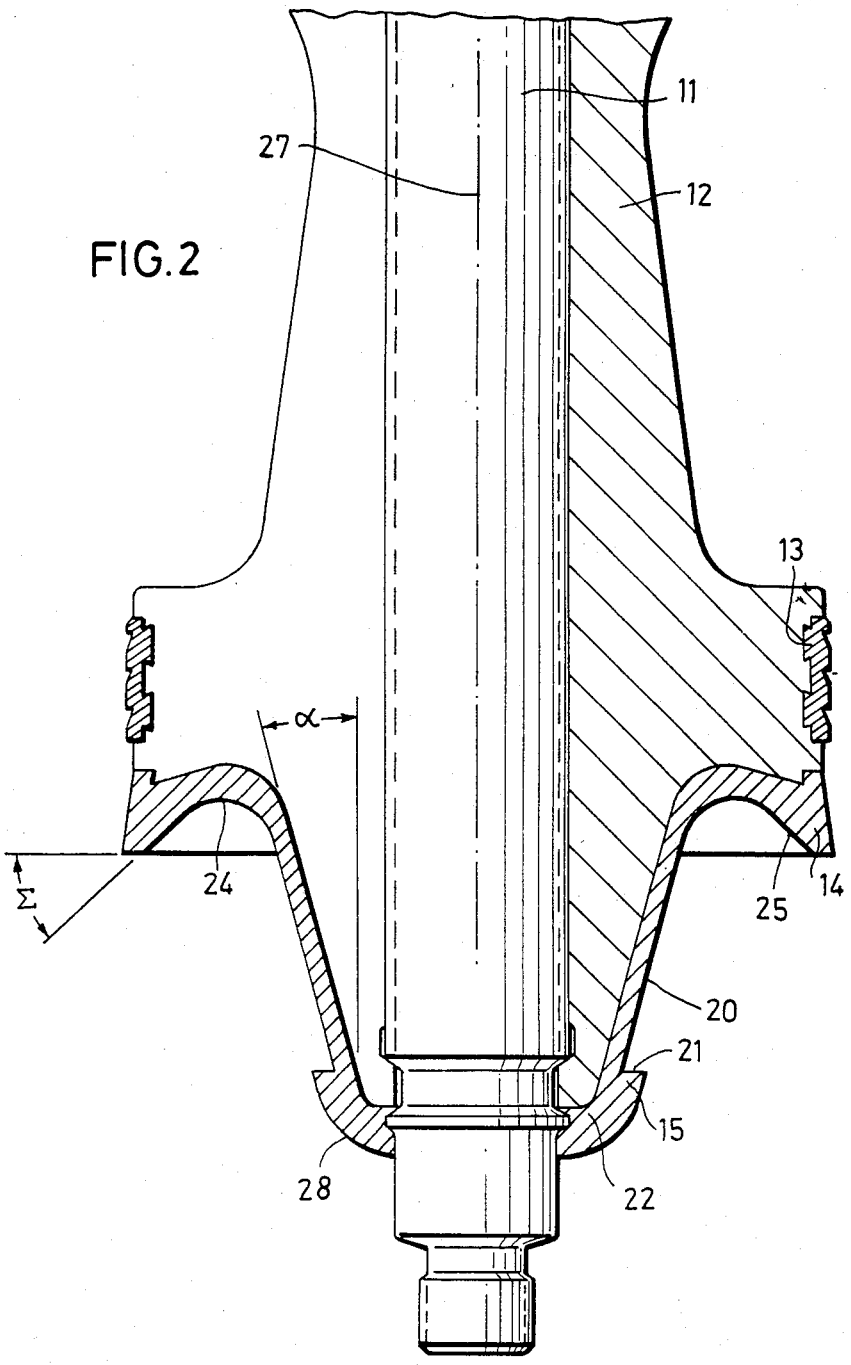
FIG. 2 is a view of a longitudinal section through a part piece of a sub-caliber shell of the cartridge ammunition.

These shape-adapted surfaces are shown in FIG. 2. They comprise first the surface 24 of a circular groove recess 26, which is formed into the tail part of the sabot 12, further a truncated cone-shaped surface 20, which is connected in a radial direction toward the center to the surface 24 and finally the surface 21 of a step 15 at the tail part of the sabot 12. Similar to the inside radial direction, the surface 24 also in radial direction to the outside passes over into a cone-shaped surface 25.

The correspondingly adapted surfaces of the cartridge cover 23 position themselves closely to the previously mentioned surface parts during the connection process and in fact in the way that the bulge 19 of the cartridge cover 23 is supported at the surface of the annular groove recess 26 and in part also at the surface 25, while the part 18 of the cartridge cover 23 is positioned with its full area against the cone-shaped surface 20 and the part 18 sits with its end piece at the surface 21 of the step 15. The sabot 12 carries a conventional guide band or guide collar 13. The tail part of the sabot has its total rear surface covered with the seal 14. This seal preferably is comprised of silicone rubber, which is vulcanized to the tail of the propelling cage. The previously mentioned fitting surfaces, to which the parts of the cartridge cover position closely, are in accordance with the invention disposed in this seal 14. Upon insertion of the shell into the propellant case the material of the seal yields and thus allows a form-adapted joining of the parts of the cartridge cover 23 to the seal 14. The surface of the annular groove recess 26 passes both in radial direction toward the inside as well as toward the outside over into conically-shaped surfaces 25 and 20. The face 20 forms an acute opening angle $\alpha$, which preferably does not surpass a value of 20°. On the other hand the face 25 encloses an angle of preferably from about 40° to 50° with a plane disposed vertically to the longitudinal axis of the shell 27. The end piece 22 of the seal 14 on the tail side, which carries the step 15, is furthermore bordered by a toroidal surface 28 in part. These features allow to insert the shell with particular ease into the propellant case to be attached, on the other hand after the catching of the catch connection there results a shape-adapted and permanent connection between the shell and the propellant case in the area of the cartridge cover 23.

Figure 3:
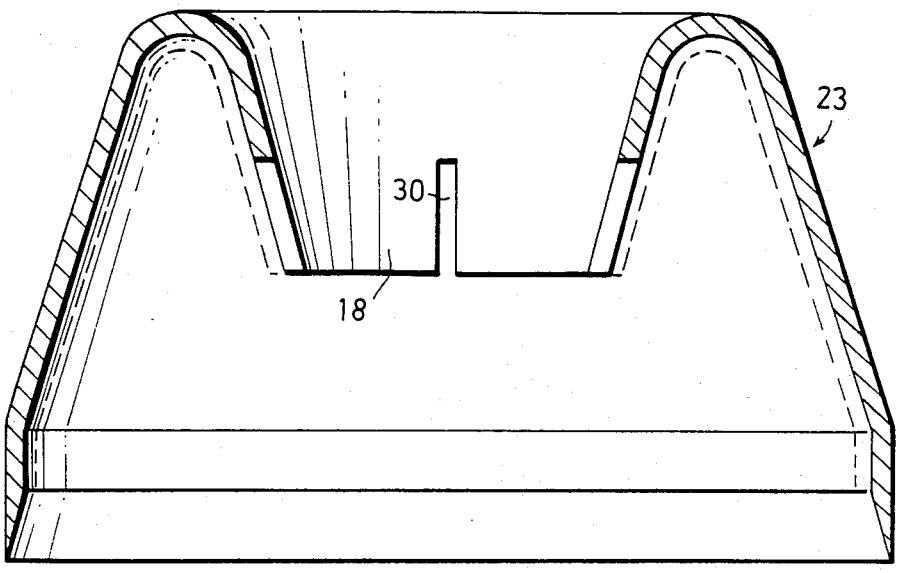
FIG. 3 is a view of a longitudinal section through the cartridge cover of a combustible propellant case.
Figure 4:
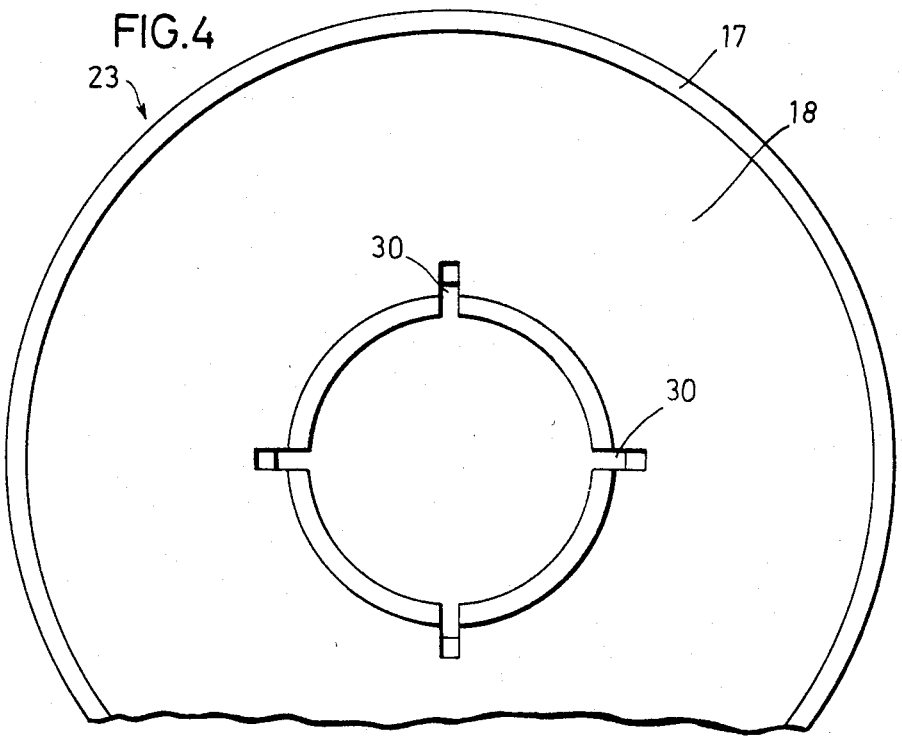
FIG. 4 is a plan view onto the cartridge cover of a combustible propellant case.

Referring now to FIG. 3 there is shown a longitudinal section of the cartridge cover 23, while FIG. 4 shows a plan view of the cartridge cover 23. In order to allow for a spring-positioned contacting of the cartridge cover part 18 to the contact surface 20 of the seal 14 and thus to assure a good form fitting between these surfaces, the radially toward the center protruding part 18 of the cartridge cover 23 is advantageously slotted, which part 18 is generated by bulge-like bending of the cartridge cover material. Preferably the slots are distributed uniformly over the circumference of the part 18. It has proven to be particularly advantageous as is shown in the embodiment of FIG. 4 to provide four slots 30, which have an angular distance from each other of 90°. Starting with the tip of the part 18 the slots 30 are such disposed into the part 18 that they reach at most to about the middle of the part 18. This assures that the part 18 is provided with sufficiently good spring properties and on the other hand with a sufficient strength.

Already by way of the catch connection according to the invention by itself a permanent connection between the propellant case and the shell can be provided, which meets all requirements imposed. In order to safely exclude that environmental influences could negatively affect the propellant, in particular with extended storage times or upon storage under adverse environmental conditions, the catch connection can additionally be strengthened with an adhesive material. For this purpose the surface intended to provide the connection of the seal 14 or of the part 18 of the propellant case cartridge cover 23 are covered with a suitable adhesive material before the insertion of the rear part of the shell into the propellant case. After the catch connection is provided the adhesive material hardens.

In addition to the previously mentioned advantages of the elimination of bolts, which were required in conventional connection between propellant case and shell, the present invention also reduces the ballast weight of the cartridge ammunition advantageously. The increase in the ratio of pay load to ballast weight is particularly advantageous with unit of a kinetic energy projectile (kinetic energy ammunition).

Thus it will be seen that there is provided a cartridge ammunition and a method which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawing is to be interpreted as illustrative and not in a limiting sense.

I claim:

1. Cartridge ammunition comprising a sub-caliber shell;

a sabot having an end facing rearwardly which sabot is detachably mounted on the shell;

said end surface including at least one stepped portion; and a propellant case including a cartridge cover connection with said end surface of said sabot, said cartridge cover includes a flexible radially innermost portion which is biased radially outwardly when contacting said stepped portion, a minimum diameter of said radially innermost portion being smaller than a maximum diameter of said stepped portion, whereby when said cartridge cover is fully assembled with said sabot it makes conjugating contact with end surface and snap inwardly so as to form an essentially non-detachable connection with said sabot.

2. The cartridge ammunition according to claim 1, wherein the stepped portion provides snap-in locking of propellant case to the sabot.

3. The cartridge ammunition according to claim 1, wherein the stepped portion provides clamping of the propellant case to the sabot.

4. The cartridge ammunition according to claim 1, wherein the cartridge cover is U-shaped bent and comprises spring parts protruding toward the axis and is shaped to conjugatingly contact said end surface of the sabot concentrically surrounding the shell.

5. The cartridge ammunition according to claim 4 further comprising slots disposed at the spring parts extending toward the axis of the U-shaped bent cartridge cover which is combustible.

6. The cartridge ammunition according to claim 5, wherein the slots are distributed uniformly over the circumference of the center end of the cartridge cover.

7. The cartridge ammunition according to claim 6 wherein a total of four slots are provided disposed at angle intervals of 90° relative to each other.

8. The cartridge ammunition according to claim 6 wherein the slots extend at most to about the middle of the center end protruding radially toward the axis.

9. The cartridge ammunition according to claim 1 where the surfaces of the tail part of the sabot are matingly shaped with respect to the front surface of the cartridge cover.

10. The cartridge ammunition according to claim 9 where the surface of the tail part of the sabot includes a stepped portion;

a truncated cone-shaped surface against which center ends said radially inward portion of the cartridge cover are pressing; and said stepped portion is disposed in a plane vertical to the longitudinal axis of the shell and against which the tip of the center end of the cartridge cover becomes locked.

11. The cartridge ammunition according to claim 1 further comprising a seal covering the tail part of the sabot.

12. The cartridge ammunition according to claim 11 where the truncated cone-shaped surface disposed toward the axis of the shell forms an acute angle with the axis of the shell.

13. The cartridge ammunition according to claim 12 wherein the acute angle is below 20°.

14. The cartridge ammunition according to claim 1 wherein said sabot has a tail side comprising an annular recess having front and rear truncated cone-shaped surfaces, said rear truncated cone-shaped surface being disposed away from the axis of the shell at an angle of from about 40° to 50° with a plane verticle to the longitudinal axis of the shell.

15. The cartridge ammunition according to claim 1 further comprising a guide collar surrounding the circumference of the sabot.

* * * * *